US005597240A

United States Patent [19]

Fyfe

[11] Patent Number: 5,597,240

[45] Date of Patent: Jan. 28, 1997

[54] STRUCTURAL BEARING

[75] Inventor: Edward R. Fyfe, Del Mar, Calif.

[73] Assignee: Hexcel-Fyfe Co., L.L.C., San Diego, Calif.

[21] Appl. No.: 610,375

[22] Filed: Mar. 4, 1996

[51] Int. Cl.[6] ..... F16C 27/06; E01D 19/06

[52] U.S. Cl. ..... 384/36; 14/73.5; 52/167.1

[58] Field of Search ..... 384/36; 14/73.5; 52/167.4, 167.7, 167.8, 167.9, 167.1

[56] References Cited

U.S. PATENT DOCUMENTS

| | | | |
|---|---|---|---|
| 3,782,788 | 1/1974 | Koester et al. | 17/73.5 |
| 3,806,975 | 4/1974 | Fyfe | 14/73.5 |
| 3,921,240 | 11/1975 | Fyfe | 14/73.5 |
| 4,033,005 | 7/1977 | Czernik et al. | 14/73.5 |
| 4,187,573 | 2/1980 | Fyfe et al. | 14/73.5 |
| 4,695,169 | 9/1987 | Baigent | 384/36 |
| 5,201,155 | 4/1993 | Shiimoda et al. | 52/167.7 |
| 5,466,068 | 11/1995 | Andra et al. | 384/36 |

*Primary Examiner*—Thomas R. Hannon
*Attorney, Agent, or Firm*—John J. Murphey; Murphey Law Offices

[57] ABSTRACT

A structural bearing including a first, rigid-support member for mounting on a structure on which the bearing is supported; a layer of first elastomeric material mounted on top of the first support member; a second, rigid-support member for operative engagement with a structure supported by the bearing mounted on top of the layer of elastomeric material; a pin rigidly attached to one of the support members and extending through the layer of first elastomeric material; a ring, extending from the rigid-support member to which the pin is not attached, to surround the pin and remain spaced-apart therefrom and extending at least partially about the free end thereof to form a cavity thereabout; and, a ring-shaped layer of second elastomeric material interposed the ring and the pin and in contact with the layer of first elastomeric material for sharing the components of the vertical, horizontal, rotational and torsional loads on the bearing.

55 Claims, 4 Drawing Sheets

STRUCTURAL BEARING

BACKGROUND OF THE INVENTION

1. Field of the Invention

This invention pertains to the field of structural bearings used to support bridges and buildings. More particularly, this invention pertains to improvements in structural bearings that render them capable of lower manufacturing and installation costs than those presently on the market, as well as enhanced qualities such as the ability to withstand greater and more varied loads.

2. Description of the Prior Art

It has been known, for many years, to place bearings under large buildings and bridges where they contact the earth. The dead weight of the structure must be supported. In addition, thermal expansion of the structure, wind striking the sides of the structure, and earthquake temblors all place loads on the structure that will move the structure and cause damage to the underlying support piers and pilings unless a means is provided for relieving the stresses generated by these loads.

Most structural bearings include a layer or layers of elastomeric material such as natural rubber, polyurethane rubber, EPDM (ethylene propylene diamine) rubber, SBR (styrene butadiene rubber), Neoprene® rubber and the like. The rubber layer takes the vertical load in compression from the dead weight of the building while most of the other loads (wind and earthquake) create horizontal forces that place the rubber layer in shear. Other loads, such as rotation, turning, and tilting are created by a combination of these forces. All of them must be adequately contained in the structural bearing in order to prolong the quality of the building or bridge construction.

The prior art structural bearings have in large part been created by me and are disclosed and claimed in my previous patents, such as U.S. Pat. Nos. 3,806,975; 3,921,240; and, 4,187,573. These bearings are rather expensive to manufacture and require certain skills in setting and installing them. Many of them cannot be visually inspected because of where they must be installed.

Structural engineers are designing buildings and bridges that place increased demands on these bearings. These demands require that the bearings support a greater dead load and be capable of handling a variety of transient loads, as well as be cheaper to construct and easier to install in locations capable of visual inspection after installation. Further, they must be handled by persons of lesser abilities than before due to the general decline in competency in the American work force.

SUMMARY OF THE INVENTION

This invention is based largely on the discovery that multiple elastomeric materials of different stiffness or other physical properties, combined in a single bearing, can better handle the dead load, and these additional rubber components can share with the main rubber layer to handle a wider range of transient horizontal and torsional loads with greater efficiency without placing the metal bearing components under stress. One result of this invention is that the bearing structure will handle a wider variety of loads over a longer period of time and will not wear out at the short rate of the prior art bearings.

This invention comes in three embodiments: In the first embodiment, the structural bearing comprises a first rigid support member for mounting on a structure on which the bearing is supported; a first layer of elastomeric material mounted on top of the first support member; a second rigid support member for operative engagement with a structure supported by the bearing mounted on top of the layer of elastomeric material; a pin rigidly attached to one of the support members and extending through the layer of first elastomeric material; a ring extending from the rigid support member to which the pin is not attached to surround the pin and remain spaced-apart therefrom and extend at least partially about the free end thereof to form a cavity thereabout; and, a ring-shaped second layer of elastomeric material interposed the ring and the pin and in contact with the first layer of elastomeric material, where the elastomeric materials making up the first and second layers may have different physical properties, for sharing the components of the vertical, horizontal and torsional loads on the bearing.

The second embodiment comprises a first rigid support member, defined by a first perimeter, for mounting on a structure on which the bearing is supported; a first layer of elastomeric material centrally mounted on top of the first support member short of, or inside, the perimeter of this first member; a second rigid member mounted on top of the layer of elastomeric material and defined by a second perimeter extending beyond the layer of first elastomeric material; a plurality of pins rigidly attached to one of the support members between its perimeter and outside the first layer of elastomeric material and extending across and through the other support member between its perimeter and outside the first layer of elastomeric material; the pins containing means restricting movement of the support member through which they extend from sliding further from the first layer of elastomeric material; a second layer of elastomeric material interposed the pins, the movement-restricting means and the rigid member through which the pins extend to share with the first layer of elastomeric material the vertical, horizontal and torsional components of load applied thereto; a third layer of low-friction elastomeric material mounted on top of the second support member, a third rigid support member mounted on top of the third layer of elastomeric material for operative engagement with the structure supported by the bearing and having a ring formed thereabout extending over the perimeter of the second support member to control and restrict lateral movement between the structure and the bearing.

The third embodiment comprises a first rigid support member for mounting on a structure on which the bearing is supported; a first layer of elastomeric material mounted on top of the first support member; a second, rigid member mounted on top of the first layer of elastomeric material; a pin rigidly attached to one of the support members and extending through the first layer of elastomeric material toward the other member; a ring surrounding the pin and spaced-apart therefrom and extending at least partially about the free end thereof to form a cavity thereabout; a second layer of elastomeric material located in the cavity formed between the ring and the pin and in contact with the first layer of elastomeric material for sharing the components of the vertical, horizontal and torsional loads on the bearing; a third rigid support member for operative engagement with a structure supported by the bearing mounted on top of the second rigid member; a third layer of low-friction material interposed the second rigid member and the third rigid support member for allowing horizontal intermovement therebetween, such as due to earthquake loads; the third support member defined by a collar extending toward and about the perimeter of the second member; and, a fourth, ring-shaped layer of elastomeric material interposed the collar and about the perimeter of the second member for damping the horizontal movement in the bearing caused by earthquake and other horizontal loads.

With respect to this third embodiment, there are other embodiments or modifications thereof that provide even further enhancement of the ability of the bearing to handle higher and more intricate transient and fixed loads. These other embodiments are modifications to the fourth, ring-shaped layer of elastomeric material interposed the collar and about the perimeter of the second member and comprise extensions of the ring-shaped layer inward into slots or bores formed about the perimeter of the second rigid member.

Accordingly, the main object of this invention is a structural bearing that uses two or more elastomeric materials, possibly having different physical properties to combine to share the vertical, horizontal, rotational and torsional loads applied thereto. Other objects of the invention include a structural bearing having enhanced load-bearing and load-handling properties, a structural bearing that is lower in cost to manufacture than existing bearings, a bearing that will handle torsional loading brought on by earthquake temblors, a bearing that is simpler to install than those of the prior art, that is manipulable by those possessing lesser abilities than workers of the past, a bearing that may be inspected and, in some cases, repaired on the spot without undue effort, and a bearing whose various components are tight-fitting to provide for average wear to all the parts during use, and not to one or more specific parts, so that the useful life of said bearing is greatly extended.

These and other objects of the invention may be observed by reading the following Description of the Preferred Embodiments in conjunction with the drawings appended hereto. The scope of protection sought by the inventor may be gleaned from a close reading of the Claims that conclude this specification.

DESCRIPTION OF THE PREFERRED EMBODIMENT

Figure 1:
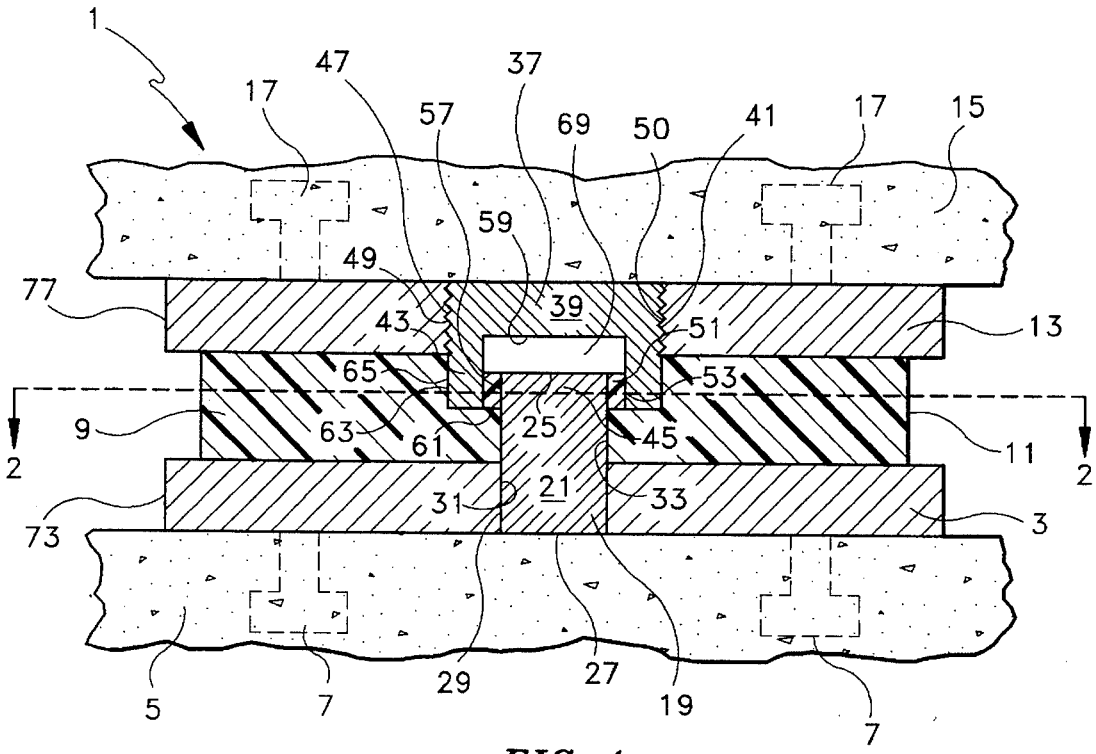
FIG. 1 is a side elevational view taken along lines 1—1 of the embodiment shown in FIGS. 2.
Figure 2:
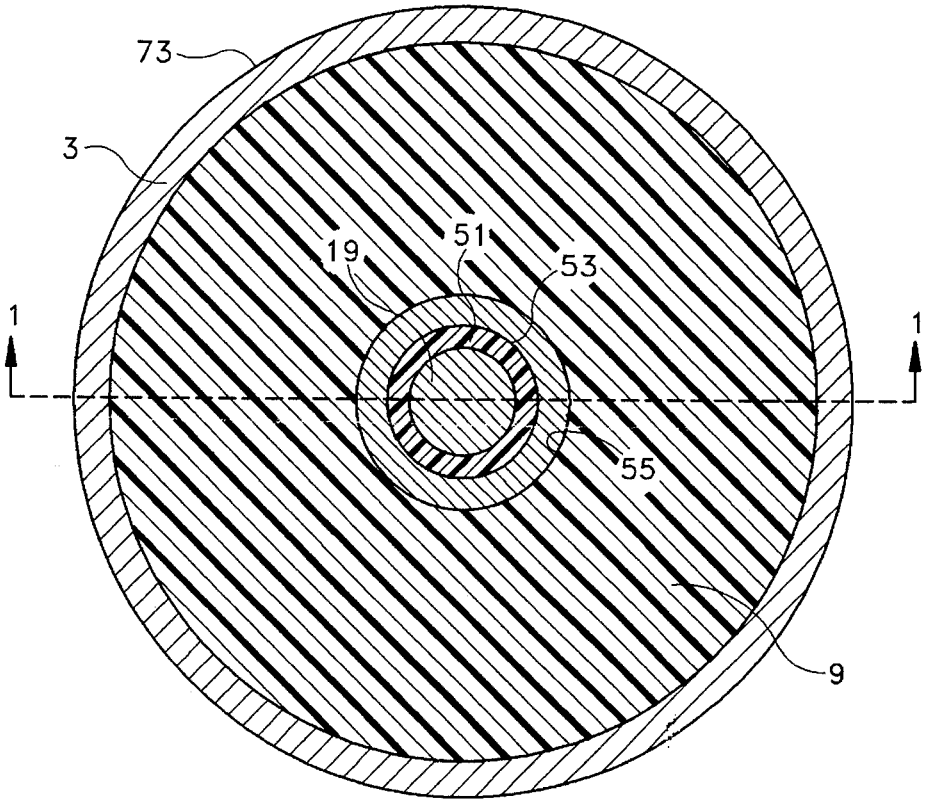
FIG. 2 is a sectional plan view taken along lines 2—2 in FIG. 1.

Turning to the drawings where like elements are identified with like numerals primes (') or double primes (") of said numerals (in different embodiments) throughout the 15 figures, the first embodiment of the structural bearing 1 of this invention is shown in FIGS. 1 and 2 and shows bearing 1 to comprise a first, rigid-support member 3 for mounting on a concrete piling 5 or other structure. Member 3 is often a flat, steel plate of geometric design such as circular, square, hexagonal, and the like. It is usually connected to a support piling 5 by bolts 7 or other known fastening means.

Mounted on top of rigid support member 3 is a first layer 9 of elastomeric material such as the rubbers mentioned previously in this specification. The thickness of layer 9 is generally determined by the dead weight of the building or bridge or other structure supported by the bearing. The procedure to determine the thickness or size layer 9 is well-known in the art. In some instances, it is preferred to bond layer 9 to the surface of first support member 3 such as by the use of adhesives. These adhesives are also well-known in the art. In addition, the shape of the outer perimeter 11 of layer 9 may take on a variety of geometric designs from a purely cylindrical shape to the concave shape, shown in U.S. Pat. No. 3,921,240, to the biconical shape shown in U.S. Pat. No. 4,187,573 and others.

Mounted to the top surface of first layer of elastomeric material 9 is a second, rigid-support member 13 for operative engagement with the structure, i.e., building, bridge, etc., supported by bearing 1. As with first support member 3, member 13 is often a flat, steel plate of geometric design such as circular, square, hexagonal, and the like. It is often the same size and shape as first support member 3 such that the entire structural bearing is symmetrical in overall appearance. Second support member 13 is usually connected to a concrete building or pier 15, located thereabove, by bolts 17 or other known fastening means. Further, as with first support member 3, second member 13 may be bonded to first layer 9 such as by the use of adhesives.

A pin 19, comprising a shaft 21 of fixed or finite length and terminated by spaced-apart distal ends 25 and 27, is rigidly attached along its lower length 29 to first, rigid-support member 3 such as by being threaded into a bore 31 formed in member 3; pin 19 extends upward toward second member 13. However, this arrangement may be reversed with shaft 21 extending downward from a similar bore formed in second member 13 toward first member 3 and this arrangement is fully contemplated in this invention. It is preferred that pin lower distal end 27 be made flush with the lower surface of first member 3 while the upper distal end 25 of pin 19 be made to terminate short of second, rigid-support member 13. Pin 19 is preferably centered in first support member 3 and made of strong steel. Its purpose is to provide a means for upper or second support member 13 to move about during the transient (rotational) loading of first layer of elastomeric material 9 such as from earthquake temblors, expansion from heat and/or vertical loading, and the like.

Pin 19 passes through a bore or passageway 33 formed in first elastomeric layer 9. Bore 33 can be of a size and shape to press against pin 19 along its entire length such as to be a tight fit. In addition, pin 19 may be glued or otherwise attached to elastomeric layer 9 such as with an adhesive. Alternatively, bore 33 can be of a size and shape as to be set back slightly from pin 19 such as to form a loose fitting therewith. Both of these configurations are contemplated in this invention.

A cup-shaped, or inverted U-shaped, member 37 is rigidly attached to second, rigid-support member 13 and comprises a center plate 39 defined by a perimeter 41 and includes a ring 43 that depends or extends downward, into a cavity formed in first layer of elastomeric material 9, from said second, support-member 13 so that said ring 43 surrounds the upper portion 45 of pin 19 and its upper distal end 25 in spaced-apart arrangement therewith. Member 37 is preferably formed of strong steel and is mounted, in or as part of, second support member 13, preferably centrally thereof, by such fastening means as threads 47 formed on the outside of member 37 that are in matching receipt with like threads 49 cut in bore 50 formed in second support member 13. Other attachment or mounting means are possible with member 37 such as welding, shrink fitting, bolting and forming as a single monolithic unit, and all of these configurations are fully contemplated in this invention. It is important for ring 43 to cover only the upper portion 45 and upper distal end 27 of pin 19.

A ring-shaped layer or annulus 51 of finite thickness of an elastomeric material is interposed ring 43 and pin 19. More specifically, the exterior surface 53 of annulus 51 is in contact with the inside surface 55 of ring 43, the exterior surface 57 of upper portion 45 of pin 19 adjacent its upper distal end 25, and the mating surface 61 of first layer 9 of elastomeric material near or adjacent bore 33. The elastomeric material of annulus 51 may be of the same or different physical properties from the elastomeric material making up first layer 9. For instance the two materials may have the same Shore Hardness or the same Durometer; or they may be different in surface friction properties, depending upon the exigencies of the particular bearing design and other factors. In addition, the exterior surface 63 of ring 43 may be bonded to the elastomeric material in first layer 9 at the mating surface 65 thereof or merely placed in physical contact with it. The important aspect of this invention is that the two elastomeric materials are in physical contact with each other and, as such, can and do share the loads, more specifically the horizontal, torsional and rotational loads, imposed on bearing 1. As shown in FIG. 1, a countersunk area or cavity 69 is formed in said first layer 9 of elastomeric material at the center thereof, to expose upper portion 45 of pin 19, the interior surface of ring 43 and the interior surface 59 of member 39.

As shown in FIG. 1, pin 19 does not extend the entire thickness of first layer 9 of elastomeric material but stops short in cavity 69 inside ring 43. Cavity 69 remains empty throughout the useful life of bearing 1 and may be instrumented to provide physical data, such as air pressure, humidity, movement of pin 19, and vibrational frequency, etc. to aid in monitoring the effectiveness of bearing 1 or providing information relative to the physical happenings to the earth below said bearing. It is preferred, however, that pin 19 extends into cavity 69 at least the thickness of annulus 51 so that the surfaces thereof will be in contact with various portions of ring 43, pin 19 and first layer 9 of elastomeric material.

Figure 3:
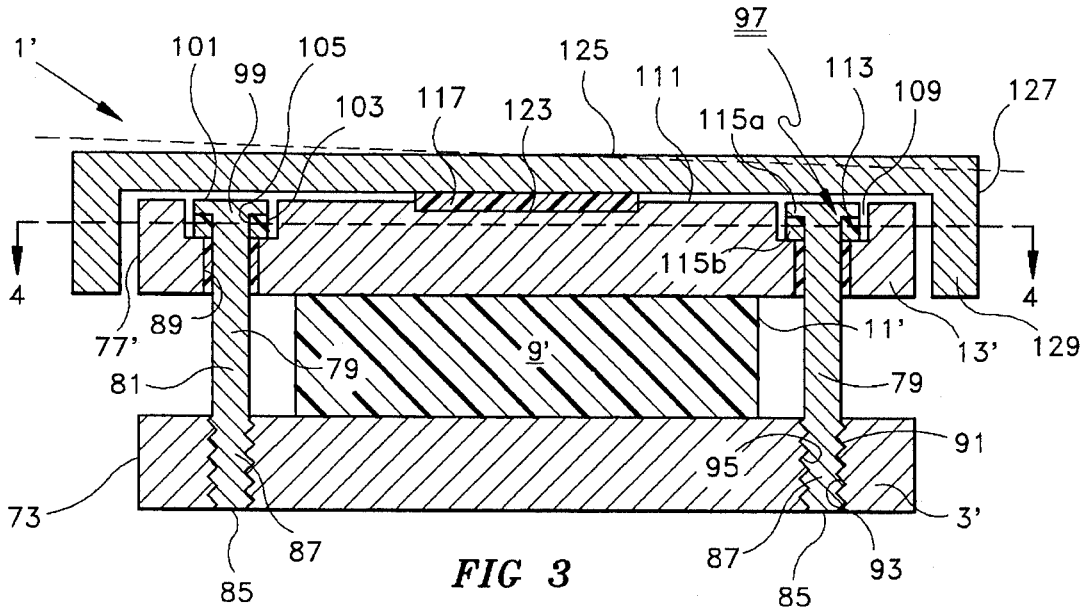
FIG. 3 is a side elevational view taken along lines 3—3 of the embodiment shown in FIG. 4.
Figure 4:
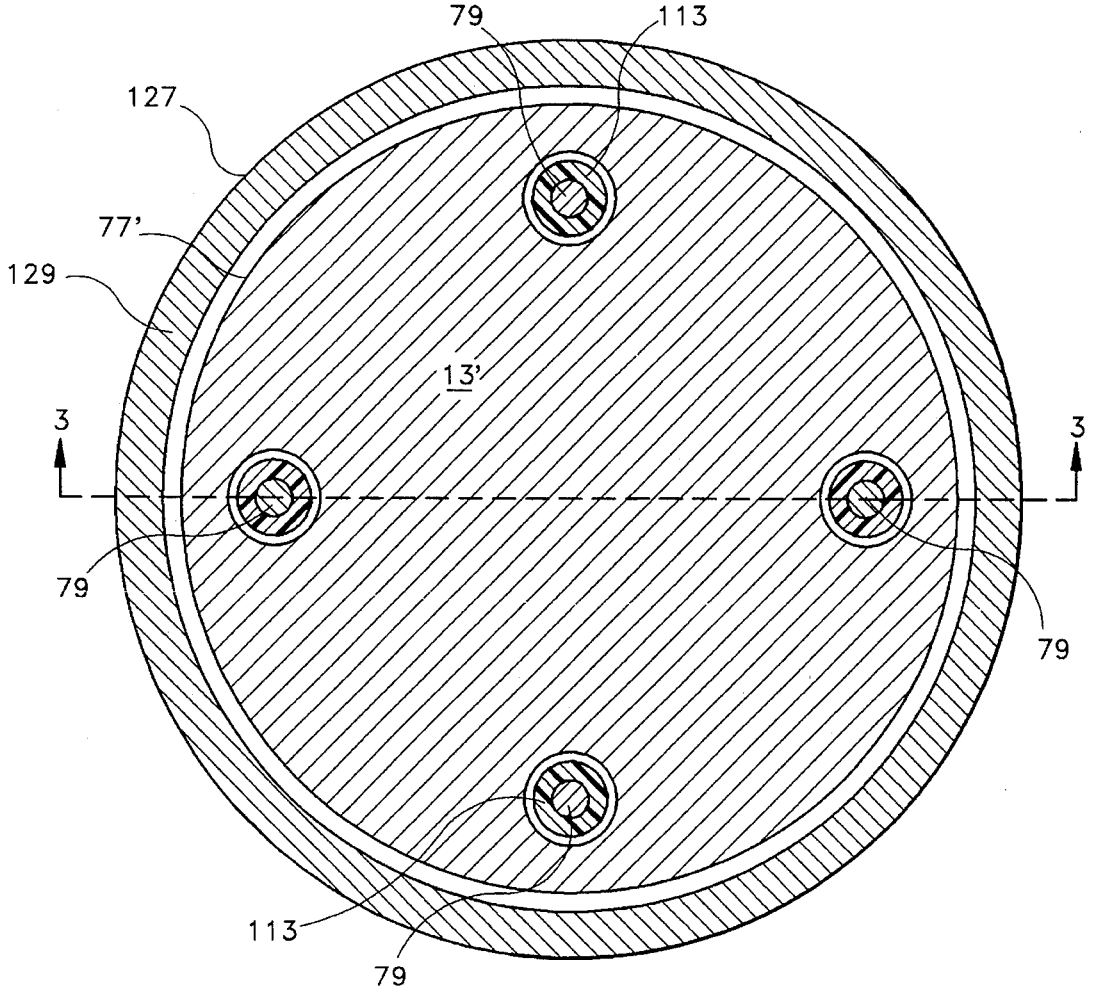
FIG. 4 is a sectional plan view taken along lines 4—4 in FIG. 3.

Referring now to FIGS. 3 and 4, the second embodiment of the structural bearing 1' of this invention is shown to comprise a first rigid support member 3', preferably a flat, steel plate of geometric design, for mounting on a concrete piling (not shown) or other structure by bolts (not shown) and further defined by a perimeter 73.

Mounted on top of support member 3' is a first layer 9' of elastomeric material such as the rubbers mentioned previously in this specification, having a thickness that is generally determined by the dead weight of the building or bridge or other structure supported by bearing 1', and covering an area defined by a perimeter 11' that is well short of, such as by 1 to 1½ inches, perimeter 73' of first support member 3'. In some instances, it is preferred to bond layer 9' to the surface of first support member 3' such as by the use of adhesives. The shape of the outer perimeter 11' of layer 9' may take on a variety of geometric designs from a purely cylindrical shape to a concave shape to the biconical shape and others.

Mounted on top of elastomeric layer 9' is a second rigid member 13' defined by a third perimeter 77' that extends beyond second perimeter 11' of first layer 9' of elastomeric material by as much as 1 to 1½ inches. As with first support member 3', member 13' is often a flat, steel plate of varying geometric design; often of the same size and shape of first, rigid-support member 3' such that bearing is somewhat symmetrical in overall appearance.

A plurality of pins 79, each comprising a shaft 81 of fixed length and terminated by a lower distal end 85, is rigidly attached along its lower length 87 to first support member 3', between the unoccupied space inside or inboard of perimeters 73' and 77' and outboard of perimeter 11' of first layer 9 of elastomeric material and extend upward through complimentary bores 89 formed in second member 13'. Pins 79 are preferably formed of strong steel and mounted in, or as part of, first support member 3', by such fastening means as threads 91 formed on the outside of pins 79 that are in matching receipt with like threads 93 cut in bores 95 formed in first support member 3'. Other attachment or mounting means are possible with pins 79 such as welding, shrink fitting, and bolting thereon and all of these means are fully contemplated in this invention. Pins 79 are preferably arranged equiangularly about member perimeters 73 and 77. It is preferred that at least four pins be placed thereabout, however, a different number may be used. Bores 89, formed in second member 13', through which bolts or pins 79 extend, may be made small in diameter so that pins 79 are tightly held therein or made larger to allow a certain amount of movement of said pins therein. In addition, when bores 89 are made large, to allow movement of pins 79 therein, elastomeric material may be inserted as a sleeve 96 (see FIG. 14) therebetween to modify the ability of said pills 79 to move freely therein. In the alternative, sleeve 96 may be made of metal or other hard substance that will be in close, frictional fit with said bores.

Means 97 is provided for restricting movement of members 3' and 3' beyond a slight pitching due to rotation, or from sliding further from said layer 9' of first elastomeric material, as shown by a dotted line in FIG. 3. Means 97 is shown to comprise a head 99 formed on the top distal end 101 of pin 79 that includes a surface 103 extending outward over a complimentary surface 105 formed in a countersunk cavity 109 formed in the top surface 111 of second member 13'.

Figure 14:
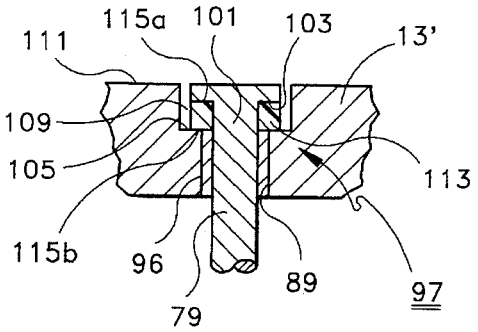

A ring-shaped layer or annulus 113 in the form of a small washer of an elastomeric material is placed on pin 79 and interposed surfaces 103 and 105 shown in FIGS. 3 and 14. The elastomeric material of annulus 113 may be of the same or different physical properties from the elastomeric material of first layer 9'. For instance, the two materials may have the same, or different, Shore Hardness or the same, or different, Durometer depending upon the exigencies of the particular building design and other factors. In addition, the upper and lower exterior surfaces 115*a* and 115*b*, respectively, of annulus 113 may be of different frictional characteristics than those of layer 9', or be bonded to both adjacent surface 103 and complimentary surface 105, or bonded to only one of them or to neither of them. The important aspect of this invention is that the elastomeric material of annulus 113 can, and will, share the loads, more specifically the horizontal, rotational and torsional loads, imposed on bearing 1'.

A third layer 117 of elastomeric material is centrally mounted on the top surface 111 of rigid second member 13', preferably in a small dish-shaped concavity 123 centrally formed therein. Layer 117 is preferably a low-friction elastomeric material, such as polytetrafluoroethylene, commonly sold under the trademark Teflon®.

A third, rigid-support member 125 is provided for operative engagement with the structure supported by bearing 1' and mounted on top of third layer 117 of elastomeric material. As with first support member 3', support member 117 is often a flat steel plate of geometric design such as circular, square, hexagonal, and is usually connected to a concrete building or pier 15', located thereabove, by bolts or other such fasteners (not shown). Member 125 is defined by a perimeter 127 that extends beyond perimeter 77' of second member 13'. From said perimeter, a wall or ring 129, that is slightly spaced-apart from perimeter 77', extends downward and outside said perimeter 77' of second member 13'. In cooperation with third layer of elastomeric material 117, third support member 125 is moveable with ease over layer 117 of low friction material and shares some of the horizontal load applied to the bearing by wind, thermal expansion, earthquake and the like.

Figure 5:
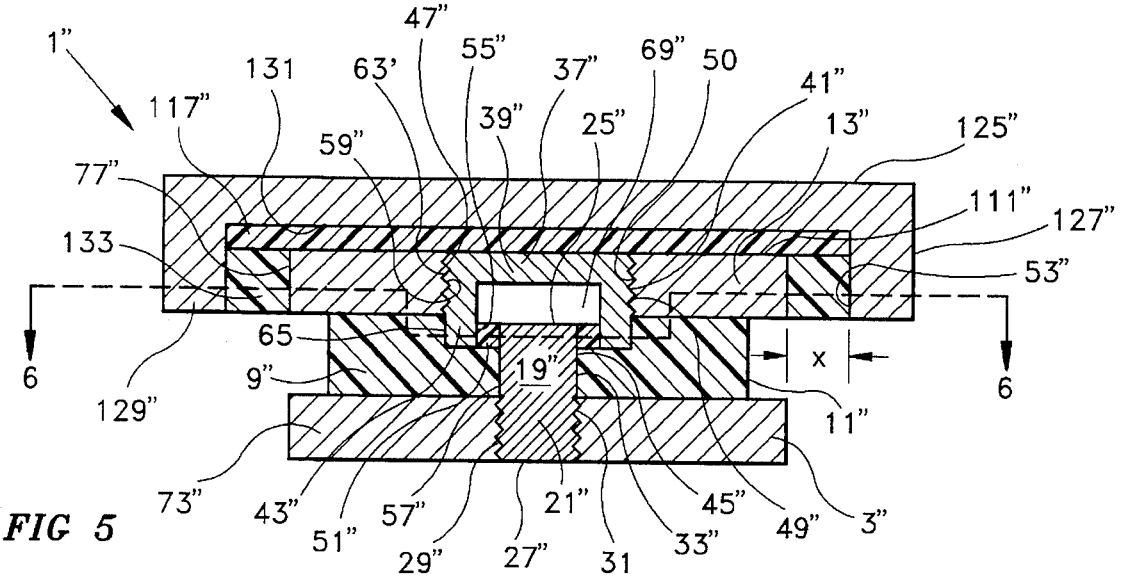
FIG. 5 is a side elevational view taken along lines 5—5 of the embodiment shown in FIG. 6.
Figure 6:
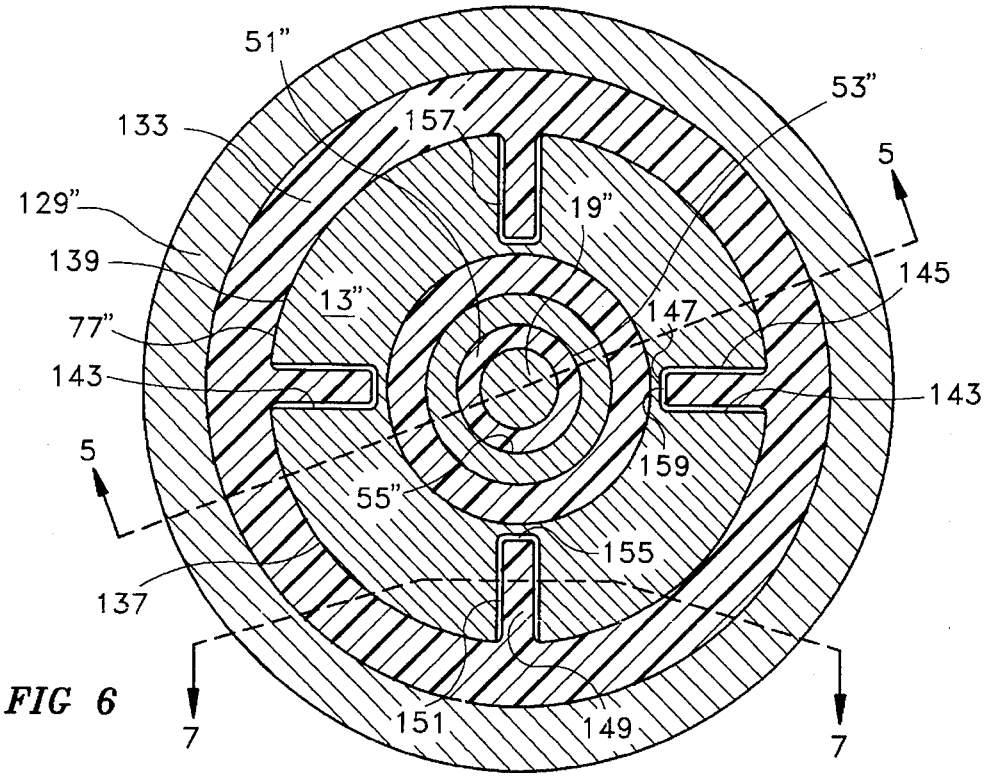
FIG. 6 is a multi-level, sectional plan view taken along lines 6—6 in FIG. 5.

Referring now to FIGS. 5, 6 and others, the third embodiment of the structural bearing 1" of this invention is shown to comprise a first rigid support member 3", often in the form of a flat, steel plate of geometric design such as circular, square, hexagonal, and the like for mounting on a structure on which bearing 1" is to be supported, such as a piling or pier, by bolts or other known fastening means (not shown).

Mounted on top of rigid support member 3" is a first layer 9" of elastomeric material, of determinable thickness, such as the rubbers previously mentioned in this specification that, in some instances, is bonded to the surface of first support member 3" such as by the use of adhesives. In addition, the shape of the outer perimeter 11" of layer 9" may take on a variety of geometric designs from a purely cylindrical shape to the concave shape to a biconical shape and others.

Mounted on top of the upper surface of layer 9" is a second rigid member 13" that is often a flat, steel plate of geometric design such as circular, square, hexagonal, and the like. Rigid member 13" is often of the same size and shape as first support member 3" such that the entire structural bearing is symmetrical in overall appearance. Further, as with first support member 3", second member 13" may be bonded to layer 9" such as by the use of adhesives.

A pin 19", comprising a shaft 21" of fixed length and terminated by distal ends 25" and 27", is rigidly attached along its lower length 29" to first support member 3" such as by being threaded into a bore 31" formed in member 3" and extends upward toward second member 13". However, this arrangement may be reversed and this reversed arrangement is fully contemplated in this invention. It is preferred that pin lower-distal end 27" be made flush with the lower surface of first member 3" while the upper, distal-end 25" of pin 19" be made to terminate short of second support member 13". Pin 19" is preferably centered in first support member 3" and made of strong steel. Its purpose is to provide a means for upper or second member 13" to move about during the transient loading of elastomeric layer 9" such as from earthquake temblors and the like.

Pin 19" passes through a bore or passageway 33" formed in first elastomeric layer 9". Bore 33" can be a tight-fit or a loose- fit therewith and both of these configurations are contemplated in this invention.

A cup-shaped, or inverted U-shaped, member 37" is fixedly attached to second rigid member 13" and comprises a center plate 39" defined by a perimeter 41" and includes a ring 43" that extends downward into first elastomeric layer 9" from said second member 13" so that said ring 43" surrounds the upper portion 45" of pin 19" and its upper distal end 25' in spaced-apart arrangement therewith. Member 37" is preferably formed of strong steel and is mounted in, or as part of, second member 13", preferably centrally thereof, by such fastening means as threads 47" formed on the outside of member 37" that are in matching receipt with like threads 49" cut in a bore 50" formed in second member 13". Other attachment or mounting means are possible such as welding, shrink-fitting, and bolting, and they are fully contemplated in this invention. It is important for ring 43" to cover only the upper portion 45" and upper distal end 25" of pin 19".

A ring-shaped layer or annulus 51" of finite thickness of an elastomeric material is interposed ring 43" and pin 19". More specifically, the exterior surface 53" of annulus 51" is in contact with the inside surface 55" of ring 43", the exterior surface 57" of upper portion 45" of pin 19" adjacent its upper distal end 25", and the mating surface 61" of first layer 9" of elastomeric material near or adjacent bore 33". The elastomeric material of annulus 51" may be of the same or different physical properties from the first elastomeric material. For instance the two materials may have the same or different Shore Hardness, or the same or different Durometer, depending upon the exigencies of the particular building design and other factors. In addition, the exterior surface 63" of ring 43" may be bonded to the first elastomeric material at the mating surface 65" thereof or merely placed in physical contact with it. The important aspect of this invention is that the two elastomeric materials are in physical contact with each other and, as such, can and do share the loads, more specifically the horizontal, torsional and rotational loads, imposed upon bearing 1". As shown in FIG. 5, a countersunk area or cavity 69" is formed in said first layer of elastomeric material at the center thereof, to expose upper portion 45" of pin 19", the interior surface of ring 43 and the interior surface 59" of member 39".

As shown in FIGS. 5 and 6, pin 19" does not extend the entire thickness of first layer 9" of elastomeric material but stops short in cavity 69" inside ring 43". Cavity 69" remains empty throughout the useful life of bearing 1 and may be instrumented to provide physical data, such as air pressure, humidity, movement of pin 19", and vibrational frequency, etc. to aid in monitoring the effectiveness of bearing 1" or providing information relative to the physical happenings to the earth below said bearing. It is preferred, however, that pin 19" extends into cavity 69" at least the thickness of annulus 51" so that the surfaces thereof will be in contact with various portions of ring 43", pin 19" and first layer 9" of elastomeric material.

A third, rigid-support member 125" is provided for operative engagement with the structure supported by bearing 1" and set above top surface 111" of second rigid member 13". As with first, rigid-support member 3", support member 125" is often a flat, steel plate of geometric design such as circular, square, hexagonal, and is usually connected to a concrete building located thereabove by bolts or other such fasteners (not shown). Member 125" is defined by a perimeter 127" that extends beyond perimeter 77" of second member 13". From said perimeter 127", a wall or ring 129", that is spaced-apart from perimeter 77" a distance "x" extends downward and about said perimeter 77" of second member 13".

A third layer 117" of elastomeric material is centrally mounted on the under surface 131 of third, rigid-support member 125. Layer 117" is a low-friction, elastomeric material, such as polytetrafluoroethylene, commonly sold under the trademark Teflon®.

A large ring or annulus 133 of an elastomeric material is interposed the inner surface 137 of ring 133 and the exterior wall 139 of second member 13" as shown in FIGS. 5 and 6. In cooperation with layer 117" and annulus 133, third support member 125" shares some of the horizontal load applied to first and second elastomeric materials by wind, thermal expansion, rotation, earthquake and the like. Ring 133 may be bonded to the outer surface of second support member 13" and/or to the inside surface of wall 129 and both configurations are fully contemplated in this invention.

Figure 7:
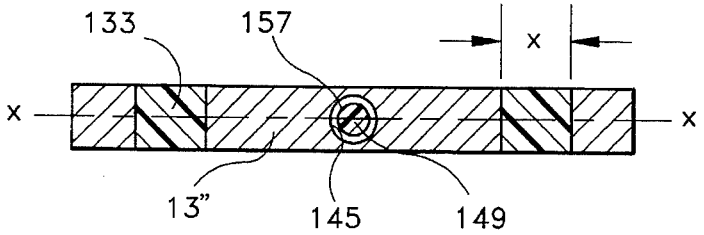
FIG. 7 is a side elevational view taken along lines 7—7 in FIG. 6.

As shown in FIGS. 6 and 7, a plurality of bores 143, each defined by a wall 145 and a bore end 147, are formed inward from perimeter 77" of second member 13" equiangularly about the center of said meter 13". Said bores 143 are preferably formed along a center plane x—x running through the middle of second member 13" as shown in FIG. 7. As shown in FIG. 6, a finger-like projection 149 is formed on ring 133 at the locations of bores 143 and are directed to extend into said bores. Projections 149 are defined by a side wall 151 and an end wall 155. As seen in FIG. 6, projection side wall 151 and end wall 155 do not extend to bore walls 145 and bore end 147, but stop short to create a wall gap 157 and an end gap 159. These gaps allow the top, or third, support member 125 of bearing 1" to move slightly with respect to the bottom or first support member 3" of bearing 1" without loading any of the layers of elastomeric material. This allowance of small movements does not stress the elastomeric material and thus prolongs the life of the material.

Figure 8:
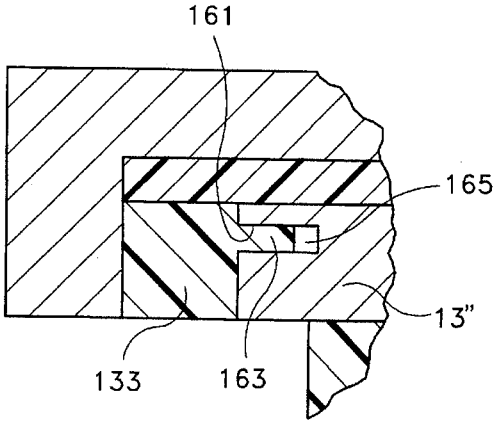
FIG. 8 is a close-up, sectional view of the upper left quadrant of the embodiment shown in FIG. 5 showing a modification thereto.

FIG. 8 shows another modification where a channel 161 is formed interior of perimeter 77" of second member 13" for receipt therein of an inwardly directed flange 163 formed on the interior surface of ring 133 of elastomeric material. A gap 165 is created because flange 163 stops short of the full depth of said channel 161. This design provides the same allowance of slight motion as does projections 149 in stopping short of the bottom of bore 143 for unrestrained intermovement between said third, rigid-support member 125 and said first, rigid-support member without loading the elastomeric materials. However, with channel 161 extending 360° about second member 13", the ability of bearing 1" to move in all directions is assured.

Figure 9:
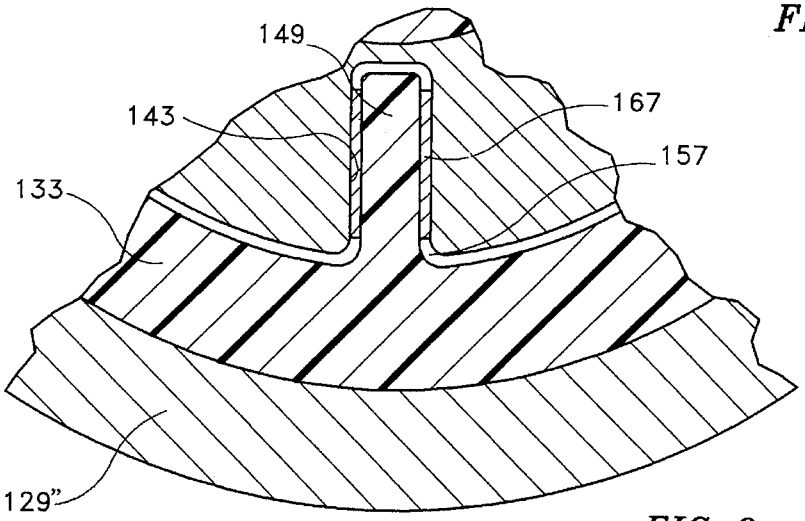
FIG. 9 is a close-up, sectional view of the lower left quadrant of the embodiment shown in FIG. 6 showing a modification thereto.

FIG. 9 shows a modification of the bearing 1" shown in FIG. 6 by interposing a metal or solid-wall sleeve 167 in wall-gap 157 to place a known amount of friction between projection 149 and bore 143. This aids in keeping the bearing under a slight load at all times and reduces any chance of snap movements or uncontrolled movements in bearing 1".

Figure 10:
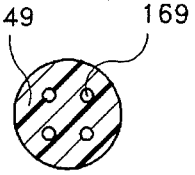
FIGS. 10 and 11 are cross-sectional views of different embodiments of the rubber extensions shown in FIG. 9.
Figure 11:
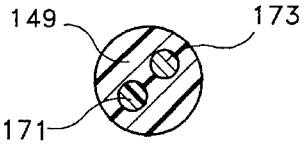

As shown in FIGS. 10 and 11, the elastomeric material making up projections 149 may themselves be modified to bring about a change in the way bearing 1" responds to various transient loads. For instance, as shown in FIG. 10, a plurality of bores or holes 169 may be formed longitudinally in projection 149, such as by the use of a removable mandrel during the molding process, to create the holes and reduce the weight of said projections. This lowering in weight will change the response of bearing 1" to a transient load. In FIG. 11, holes 169 may be formed and filled with elastomeric materials 171 of different physical properties or filled with steel or other metal wires or plugs 173 to change the response of bearing 1".

Figure 12:
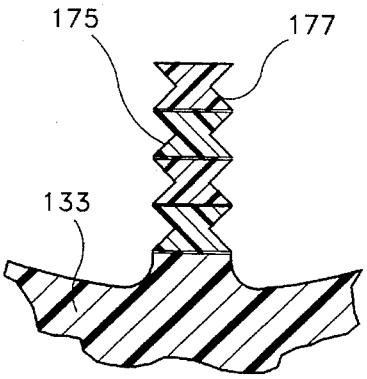
FIG. 12 is a close-up view of another embodiment of the rubber extension shown in FIG. 9.
Figure 13A:
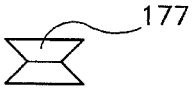
FIGS. 13*a* and 13*b* are end and side views respectively of the element making up the rubber extension shown in FIG. 12; and, FIG. 14 is a close-up, sectional view of a modification of a portion of the embodiment shown in FIG. 3.
Figure 13B:
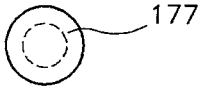

In FIG. 12, a spring 175 can be made of dumbbell-shaped pieces 177 of polyurethane rubber (shown in FIGS. 13*a* and 13*b*) glued end-to-end, as shown, to provide a singular response in bore 143 when bearing 1" is subject to transient forces.

While the invention has been described by reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve the same results are within the scope of this invention.

What is claimed is:

1. A structural bearing subjected to loads having vertical, horizontal, rotational and torsional components comprising:

a) a first, rigid-support member for mounting on a structure on which the bearing is supported;

b) a first layer of elastomeric material mounted on top of said first support member;

c) a second, rigid-support member for operative engagement with a structure supported by the bearing mounted on top of said first layer of elastomeric material;

d) a pin of finite length and terminated by spaced-apart distal ends rigidly attached at one said distal end to one of said support members and extending through said first layer of elastomeric material toward said other support member;

e) a ring extending, from said support member to which said pin is not attached, toward and surrounding said other distal end of said pin and spaced-apart therefrom and further extending at least partially about the free end of said pin thereof to form a cavity thereabout; and, f) a ring-shaped layer of elastomeric material interposed said ring and said pin and in contact with said first layer of elastomeric material, said first layer of elastomeric material and said ring-shaped layer of elastomeric material for sharing the components of the vertical, horizontal, rotational and torsional loads on the bearing.

2. The structural bearing of claim 1 wherein said ring is attached to said second, rigid-support member through an inverted U-shaped member.

3. The structural bearing of claim 1 wherein said first, rigid-support member includes a flat plate.

4. The structural bearing of claim 1 wherein said first layer of elastomeric material is bonded to said first, rigid-support member.

5. The structural bearing of claim 1 wherein said first layer of elastomeric material is not bonded to said first support member.

6. The structural bearing of claim 1 wherein said second support member includes a flat plate.

7. The structural bearing of claim 1 wherein said first and said second support members are of the same size and shape.

8. The structural bearing of claim 1 wherein said pin is attached to said first support member and extends upward, toward said second support member.

9. The structural bearing of claim 1 wherein said ring and said member front which it extends are formed as a monolithic unit.

10. The structural bearing of claim 1 wherein said ring is countersunk into said first layer of elastomeric material to form a cavity therein exposing the terminal end portion of said pin.

11. The structural bearing of claim 1 wherein the physical properties of said ring-shaped layer of elastomeric material are different from the physical properties of said first layer of elastomeric material.

12. The structural bearing of claim 1 wherein said ring-shaped layer of elastomeric material is bonded to said first layer of elastomeric material.

13. The structural bearing of claim 1 wherein said ring-shaped layer of elastomeric material is not bonded to said first layer of elastomeric material.

14. The structural bearing of claim 1 wherein said pin extends through a passageway formed in said first layer of elastomeric material and said passageway is formed tight to said pin.

15. The structural bearing of claim 1 wherein said pin extends through a passageway formed in said first layer of elastomeric material and said passageway is formed loose about said pin.

16. The structural bearing of claim 1 wherein said pin terminates short of the thickness of said first layer of elastomeric material.

17. Tile structural bearing of claim 1 wherein the thickness of said first layer of elastomeric material is narrower in the area adjacent said pin than in the area spaced-apart from said pin between said first and said second support members.

18. The structural bearing of claim 1 wherein the stiffness of said first layer of elastomeric material is greater than the stiffness of said ring-shaped layer of elastomeric material.

19. The structural bearing of claim 1 wherein said pin is centrally mounted in said support member.

20. The structural bearing of claim 1 wherein said pin is mounted to said second support member and is projected upward toward said first support member.

21. The structural bearing of claim 1 wherein said cavity extends above said terminal end of said pin and is free of any elastomeric material.

22. A structural bearing subjected to loads having vertical, horizontal, rotational and torsional components comprising:

a) a first, rigid-support member, defined by a first perimeter, for mounting on a structure on which the bearing is supported;

b) a first layer of elastomeric material centrally mounted on top of said first, rigid-support member having a second perimeter that is short of said first perimeter;

c) a second rigid member mounted on top of said first layer of elastomeric material and defined by a third perimeter extending beyond said second perimeter;

d) a plurality of pins rigidly attached to one of said support members, outboard of said second perimeter and inboard of said first and said third perimeters and extending across and through complimentary bores formed in said other support member;

e) said pins containing means restricting movement of said support member through which they extend from sliding further from said first layer of elastomeric material;

f) a ring-shaped layer of a second elastomeric material interposed said means of each said pin and said second rigid member for cooperating with said first layer of elastomeric material to share the physical load imposed on said bearing;

g) a third layer of elastomeric material centrally mounted on top of said support member through which said pins extend;

h) a third, rigid-support member for operative engagement with a structure supported by the bearing mounted on top of said third layer of elastomeric material and defined by a second perimeter extending beyond said perimeter of said second rigid member; and, i) a wall extending from said perimeter of said third, rigid-support member downward toward and about said second, rigid-support member to restrict the horizontal movement of said third support member.

23. The structural bearing of claim 22 wherein said first support member includes a flat plate.

24. The structural bearing of claim 22 wherein said first layer of elastomeric material is bonded to said first support member.

25. The structural bearing of claim 22 wherein said third layer of elastomeric material is a low-friction elastomeric material.

26. The structural bearing of claim 22 wherein said second member includes a flat plate.

27. The structural bearing of claim 22 wherein said first and said second members are of the same size and shape.

28. The structural bearing of claim 22 wherein said pins are attached to said first support member and extend upward, toward said second rigged member.

29. The structural bearing of claim 22 wherein said means comprises a head formed on each said pin including a surface extending outward over a complimentary surface formed in a counter-sunk cavity formed in said second member.

30. The structural bearing of claim 22 further including a sleeve interposed said pins and said complimentary bores.

31. The structural bearing of claim 30 wherein said sleeves are elastomeric.

32. The structural bearing of claim 30 wherein said sleeves are metal and in close frictional fit in said bores.

33. The structural bearing of claim 22 wherein said pins are placed equiangularly about said first and second members.

34. The structural bearing of claim 22 wherein said ring-shaped layer of said elastomeric material exhibits physical properties different from those of said first layer of elastomeric material.

35. The structural bearing of claim 22 wherein said ring-shaped layer of second elastomeric material is bonded to said second rigid member.

36. The structural bearing of claim 29 wherein said ring-shaped layer of elastomeric material is bonded to said complimentary surface.

37. The structural bearing of claim 22 wherein said pins are attached to said rigid member by threadable engagement in bores formed in said rigid member.

38. The structural bearing of claim 22 wherein the physical properties of said first layer of elastomeric material is different from said ring-shaped layer of elastomeric material.

39. The structural bearing of claim 22 wherein said pins are mounted to said second rigid member and are projected downward toward, and into, said first, rigid-support member.

40. The structural bearing of claim 22 wherein said pins are four in number and equiangularly placed about the center of the bearing.

41. The structural bearing of claim 22 wherein said support member through which said pins extend has formed therein tight passageways for said pin to pass therethrough.

42. The structural bearing of claim 22 wherein said support member through which said pins extend has formed therein loose passageways for said pins to pass therethrough and said loose passageways are filled with an elastomeric material to hold said pins in fixed position therein.

43. A structural bearing subjected to loads having vertical, horizontal and torsional components comprising:

a) a first, rigid-support member for mounting on a structure on which the bearing is supported;

b) a first layer of elastomeric material mounted on top of said first, rigid-support member;

c) a second rigid member, defined by a perimeter, mounted on top of said first layer of elastomeric material;

d) a pin of finite length and terminated by spaced-apart distal ends rigidly attached at one said distal end to one of said rigid members and extending through said first layer of elastomeric material toward said other rigid member;

e) a ring extending, from said support member to which said pin is not attached, toward and surrounding said other distal end of said pin and spaced-apart therefrom and further extending at least partially about the free end of said pin to form a cavity thereabout;

f) a first, ring-shaped layer of of elastomeric material in said cavity restrained between said ring and said pin and in contact with said first layer of elastomeric material for sharing the components of the vertical, horizontal, rotational and torsional loads on the bearing;

g) a third, rigid-support member for operative engagement with a structure supported by the bearing mounted on top of said second rigid member;

h) a layer of low-friction, elastomeric material interposed said second rigid member and said third, rigid-support member for allowing horizontal intermovement therebetween due to earthquake loads;

i) said third support member defined by a perimeter greater than said perimeter of said second rigid member;

j) a ring-shaped wall extending from said perimeter of said third, rigid-support member toward and about said perimeter of said second rigid member and spaced-apart therefrom; and, k) a second, ring-shaped layer of elastomeric material interposed said wall and said perimeter of said second rigid member for damping the horizontal movement in the bearing caused by said transient loads impressed thereon.

44. The structural bearing of claim 43 wherein said layer of first elastomeric material is bonded to said first support member.

45. The structural bearing of claim 43 wherein said pin is rigidly attached to said first support and extends upward, toward said second rigid member.

46. The structural bearing of claim 43 wherein said ring and said member from which it extends are made in a monolithic unit.

47. The structural bearing of claim 43 wherein said ring is countersunk into said layer of first elastomeric material to form a cavity therein exposing the terminal portion of said pin.

48. The structural bearing of claim 43 wherein said ring-shaped layer of elastomeric material exhibits physical properties different from those of said first layer of elastomeric material.

49. The structural bearing of claim 41 further including a channel formed in said perimeter of said second rigid member for receipt therein of a flange formed on the inside of said ring of elastomeric material to provide angular stability to the bearing.

50. The structural bearing of claim 49 wherein said flange is defined by a bottom surface that does not extend to the bottom surface of said channel thereby forming a gap for unrestrained movement between said third, rigid-support member with respect and said first, rigid-support member in all directions.

51. The structural bearing of claim 49 further including:

a) a plurality of bores formed in said perimeter of said second rigid member and extending inward therefrom; and, b) a finger-like projection formed on said ring of elastomeric material adjacent each said bore for insertion therein to provide for equiangular stability of the bearing and allow controlled intermovement between said third, rigid-support member and said second rigid support.

52. The structural bearing of claim 51 wherein said finger-like projection includes at least one bore formed longitudinally therein to provide a different response to transient loads impressed on the bearing.

53. The structural bearing of claim 51 wherein said finger-like projection includes at least one bore formed longitudinally therein and filled with a material having different physical properties than the elastomer making up said projection to provide a different response to transient loads impressed on the bearing.

54. The structural bearing of claim 49 further including:

a) a plurality of bores formed in said perimeter of said second rigid member and extending inward therefrom;

b) a finger-like projection formed on said ring of elastomeric material adjacent each said bore for insertion therein to provide for equiangular stability of the bearing and allow controlled intermovement between said third, rigid-support member and said first, rigid-support; and, c) a sleeve of terminal length positioned over said projection of a size to fit snugly into said bore to control the frictional movement of said projection therein.

55. The structural bearing of claim 51 wherein said finger-like projection comprises a plurality of individual pieces of elastomeric material having physical properties different from the properties of said ring and attached together, in end-to-end fashion to form a projection having different physical properties than the elastomer making up said projection to provide a different response to transient loads impressed on the bearing.

* * * * *